US005774922A

United States Patent [19]

Bumb

[11] Patent Number: 5,774,922

[45] Date of Patent: Jul. 7, 1998

[54] BROOM HEAD FOR CHANNELING MATERIAL

[76] Inventor: James Bumb, P.O. Box 603, Coloma, Calif. 95613

[21] Appl. No.: 759,241

[22] Filed: Dec. 3, 1996

[51] Int. Cl.[6] ..... A46B 9/02

[52] U.S. Cl. ..... 15/159.1; 15/171; D4/132

[58] Field of Search ..... 15/78, 79.1, 79.2, 15/87, 159.1, 160, 167.2, 171, 172, 180; D4/132, 135; D32/15, 16

[56] References Cited

U.S. PATENT DOCUMENTS

| | | | |
|---|---|---|---|
| D. 375,632 | 11/1996 | Uranga | D4/132 |
| 417,477 | 12/1889 | Dundon | 15/78 |
| 548,201 | 10/1895 | Hvass | 15/180 |
| 550,014 | 11/1895 | Bromell | 15/78 |
| 590,288 | 9/1897 | Winspear | 15/87 |
| 1,319,493 | 10/1919 | Severanle | 15/160 |
| 1,784,567 | 12/1930 | Aultman | 15/160 |
| 3,732,590 | 5/1973 | Horst | 15/180 |
| 3,761,990 | 10/1973 | Lynn . | |
| 4,137,593 | 2/1979 | Porper | 15/167.2 |
| 4,360,940 | 11/1982 | Smith . | |
| 4,385,411 | 5/1983 | Clark . | |
| 5,006,894 | 4/1991 | Morris et al. . | |
| 5,165,134 | 11/1992 | Moore | 15/78 |

*Primary Examiner*—Randall Chin
*Attorney, Agent, or Firm*—John P. Costello

[57] ABSTRACT

A broom head for channeling spreadable material, such as sand and debris. This broom head is represented by a manual push broom embodiment and an embodiment for adaption to a motorized vehicle. In both embodiments, the arms of the broom converge at a junction to form an interior angle. The bristles bordering along this interior angle form a leading edge which channels any spreadable material toward the junction of the angle. The manual push broom embodiment adopts a V-shaped structure, thereby having a single interior angle, while the motorized embodiment adopts an X-shaped structure and thereby has at least two interior angles. The channeling ability of this broom head is especially useful for paving and road work, where sand must be channeled into cracks for purposes of repair.

1 Claim, 3 Drawing Sheets

Fig. 1
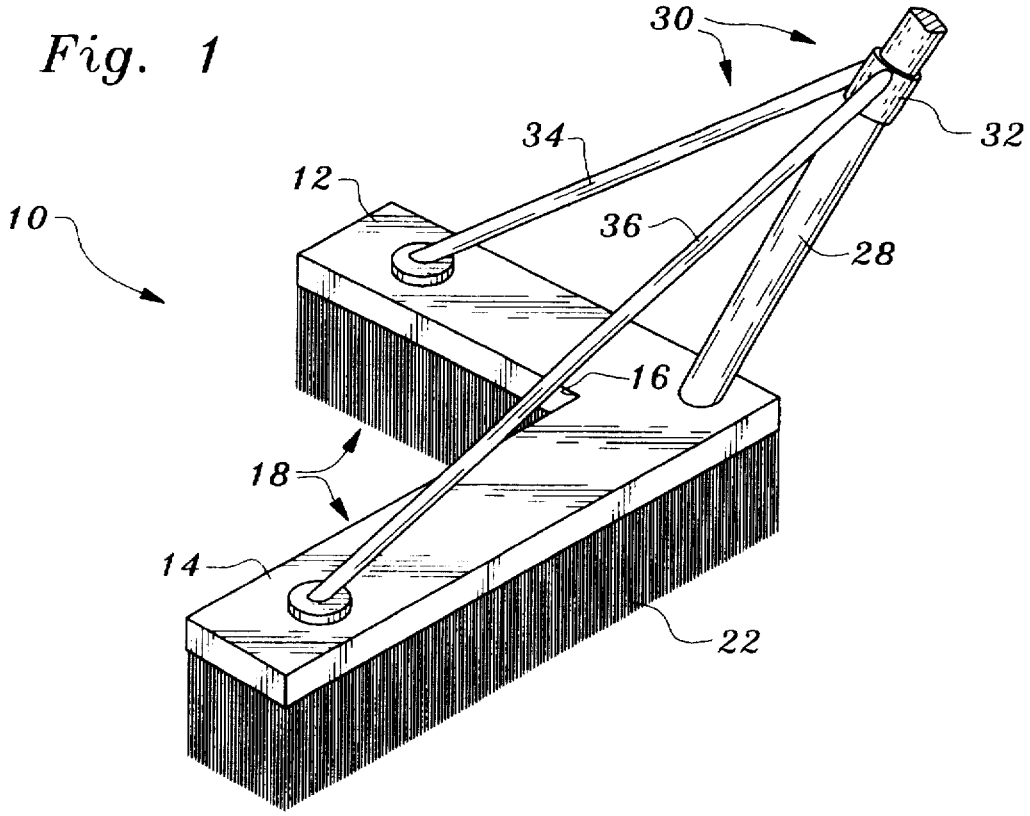
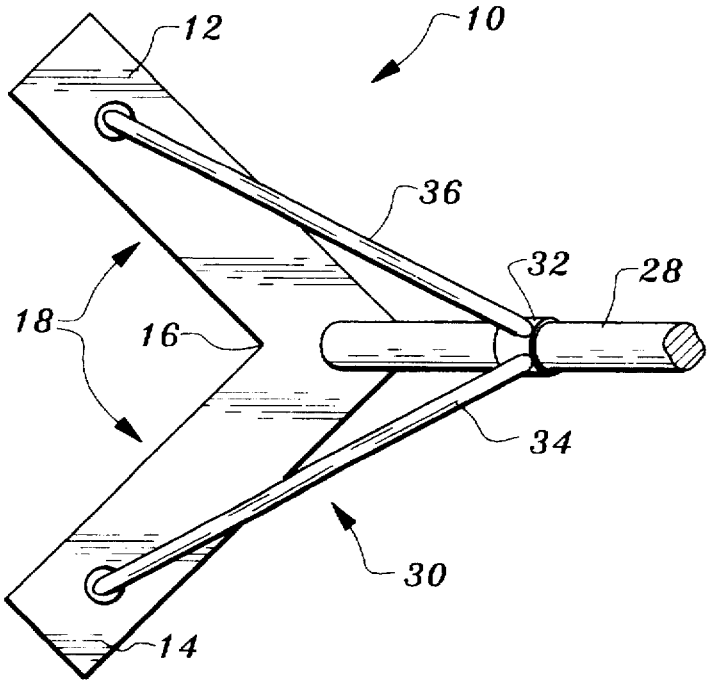
Fig. 2

BROOM HEAD FOR CHANNELING MATERIAL

BACKGROUND OF THE INVENTION

1. Field of the Invention

This invention pertains generally to brooms and more specifically to a broom head adapted to sweep matter, initially disposed in a lump, or wide path, into a narrower path or channel.

2. Description of the Background Art

Over time, paved surfaces inevitably undergo degradation from heat expansion and cold contraction. Cracks develop as a result of this natural hot-cold process, and if cracks are left unrepaired, the paved surface further degrades and crumbles. Cracks in pavement are best repaired by first using a pavement cutter which cuts the jagged cracks into straight lines, and cleans the interior of the cracks of pavement debris. Following cutting, high velocity air is blown into the straight cuts, to clean the walls of the crack of dirt and debris. Next, excessively deep cracks are filled with dry sand, this sand being swept into the cracks with standard push brooms. Finally, the crack is sealed with paving material, or tar, thereby creating an expansion joint which resists heat and cold.

This method of pavement repair usually involves a road crew, wherein one part of the crew operates the pavement cutter, one part sweeps the sand into the crack, and a another part of the crew places the paving material into the cracks. The number of cracks which can be repaired in a day is greatly dependent on how fast each of the individual tasks of cutting, sand filling and sealing can be accomplished. If the time for performing any one of these steps can be reduced, then correspondingly, the number of cracks which can be repaired in a day can be greatly increased.

The present invention increases the efficiency of the crack filling process by providing a broom head which channels a quantity of sand into a crack. This broom head allows less manpower to be used to accomplish the crack-filling step, in a shorter amount of time.

The foregoing discussion reflects the state of the art of which the inventor is aware and is tendered with a view toward discharging the inventor's acknowledged duty of candor in disclosing information which may be pertinent with regards to the patentability of the present invention.

SUMMARY OF THE INVENTION

By way of example and not of limitation, the present invention pertains to a broom head having arms which form an interior angle. Bristles depend down from these arms to form a bristle section having a leading edge bordering the interior angle for contacting sand, or other spreadable material. The arms are designed to contact a lump of sand, or other spreadable material, initially dispersed in a wide path, and channel it into a narrow path. This allows sand to be channeled into a crack, or cut, present in a portion of pavement. The arms contact the material at their widest expanse, and channel the material more narrowly as the junction of the angle between arms is reached.

This invention can be adapted to manual use or incorporated upon a tractor, or similar vehicle, used for paving. In the manual embodiment, the broom head adopts a "V"-shape and is coupled to a broom handle and a support structure. The broom handle is inclined in a direction away from the wide end of the "V", so that in an ordinary, push-sweeping motion, the user pushes the opening of the "V" towards the matter to be swept. The matter is swept forward, as by a conventional push-broom, but is also channeled inward by the V-shape of this broom head. The support apparatus is preferably a pair of elongate struts coupled to the top of the broom head at one end, and to a collar encircling the broom handle at an opposite end. These support struts are likewise inclined in an angle as they migrate from the broom head to the broom handle.

In the machine adaptable embodiment, the broom head is "X"-shaped, which allows for two interior leading edges to be arranged back to back. In this embodiment, the principle of using the wide end of the arms to channel sand or debris toward the junction of the interior angles, remains. However, because it is advantageous to use both the forward and reverse gears of a tractor, or other motorized vehicle, while filling cracks, the twin leading edges allow a motorized vehicle to move forward, or back, while still being able to bring the interior angle of the broom head to bear upon a lump of sand, or other spreadable material. In this embodiment, the broom head is coupled to an adaptor or support structure located beneath, or behind, the motorized vehicle, and held thereon.

An object of the invention is to provide a paving broom head which eliminates the necessity for the sweeper to make extra sweeps in controlling the swept matter.

Another object of the invention is to provide a broom head which channels a wide lump of sand or other spreadable material into a narrow path, or channel, for purposes of filling cracks or cuts, in pavement.

A still further object of the invention is to provide a channeling broom head which can be adapted for manual or motorized sweeping.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 1 is a perspective view of the preferred embodiment of the broom head which is the present invention, coupled to a support structure adapted for manual sweeping.

FIG. 2 is a plan view of the broom head and support structure depicted in FIG. 1.

DESCRIPTION OF THE PREFERRED EMBODIMENTS

Figure 3A:
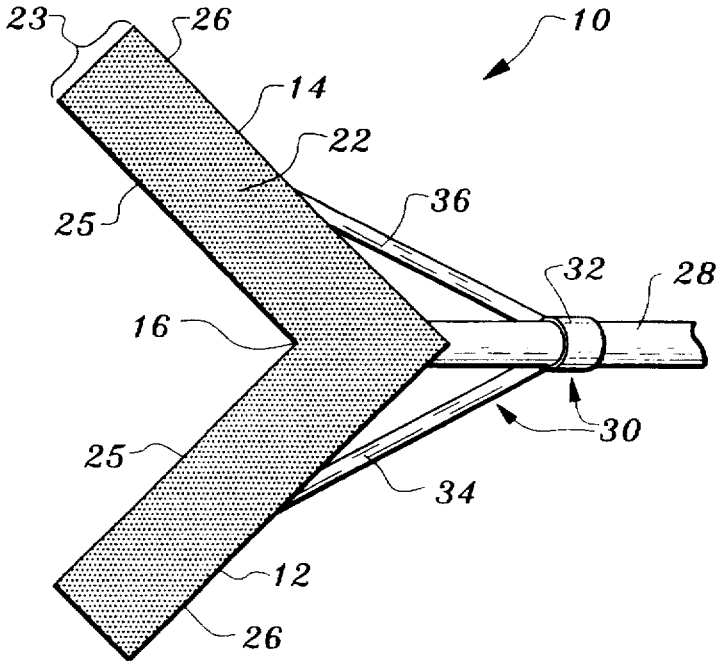
FIG. 3*a* is a bottom view of the broom head and support structure depicted in FIG. 1.

Referring more specifically to the drawings, the present invention is embodied in the broom head and its corresponding support structure generally shown in FIG. 1. It will be appreciated that the broom head and support structure shown may vary as to configuration and as to details of the parts, without departing from the basic concept as disclosed herein.

FIG. 1 illustrates the broom head 10, which includes a first arm 12 and a second arm 14. First and second arms 12, 14 are joined at junction 16, the joining of arms 12, 14 creating interior angle 18. Interior angle 18 is preferably in a range of 90 to 145 degrees, which has been found to be an optimum range for channeling sand, or other spreadable material. Arms 12, 14 are preferably molded or constructed as a single piece, for purposes of lending strength and rigidity to broom head 10.

Figure 3B:
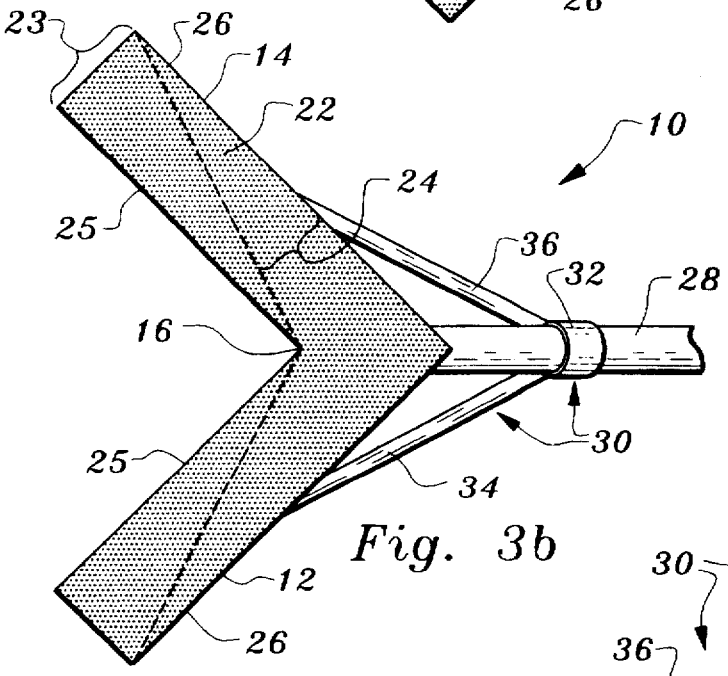
FIG. 3*b* is a bottom view of the broom head and support structure showing the bristles as having a pronounced front to back taper for purposes of maximizing the sweeping area of the broom head.
Figure 4:
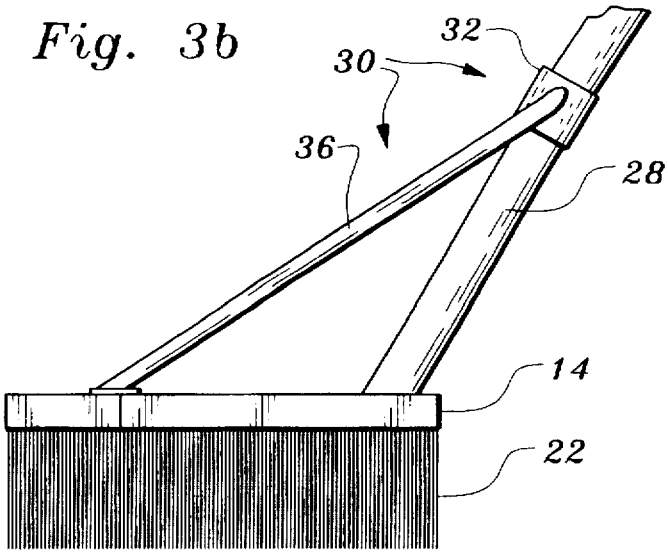
FIG. 4 is a side view of the broom head depicted in FIG. 1.

Referring also to FIGS. 2–4, it can be seen that bristles 22 depend downward from arms 12, 14 in a perpendicular relation, and occupy the underside of arms 12, 14. As seen in FIG. 3*a*, bristles 22 can be uniform in length upon arms 12, 14. It has been found to be preferable for bristles 22 to constitute a width in a range of 4 to 8 inches across plane 23, for providing an optimal amount of bristles to contact the ground, and channel paving material from a wide lump to a narrow path.

Alternately, as shown in FIG. 3*b*, bristles 22 are shown incorporating a pronounced tapered section 24, which is meant to maximize the effective width of the broom head 10 for sweeping. In this embodiment, the section of bristles 22 near the leading edge 25 of broom head 10 taper as they proceed toward the trailing edge 26 of the broom head. Hence, the bristles at leading edge 25 are longer than those at the trailing edge 26.

Handle 28 is coupled either permanently or removably to broom head 10 near junction 16. Support structure 30 lends added strength to handle 28 and allows forces caused by manually pushing broom head 10 forward to be distributed along support structure 30. Support structure 30 includes a collar 32 surrounding handle 28. Additionally, support structure 30 includes a first elongate strut 34 and a second elongate strut 36 depending downward from collar 32. First and second struts 34, 36 couple to the topside of first arm 12 and second arm 14 of broom head 10, respectively. Support structure 30 evenly distributes stress placed upon handle 28 as a result of a user placing forward pushing force upon broom head 10. By distributing pushing force evenly, upon broom head 10, support structure 30 helps prevent breakage of handle 28 due to excessive forward forces.

Figure 5:
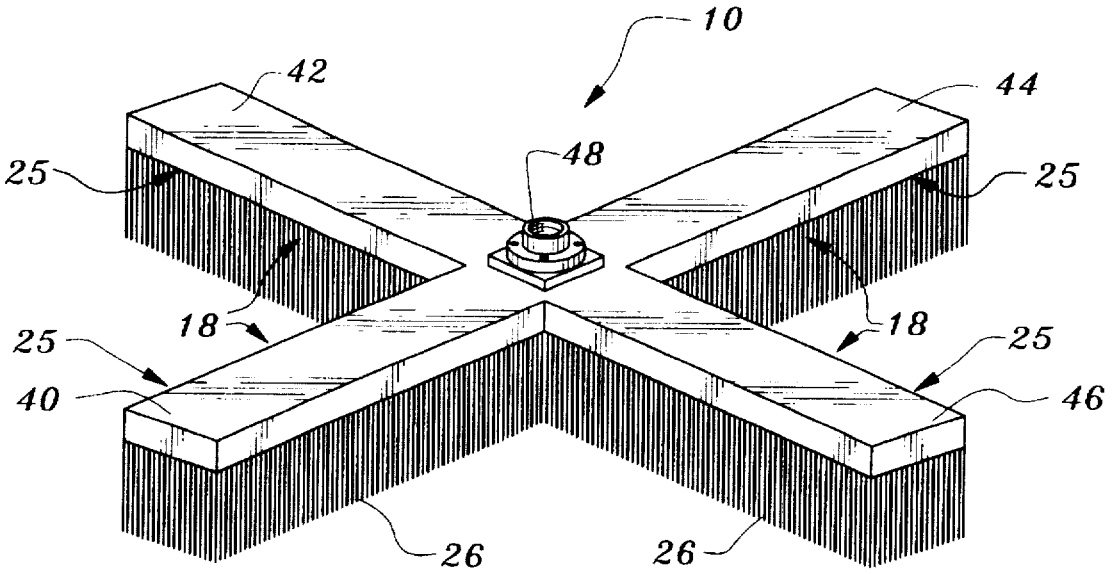
FIG. 5 is an elevated perspective view of an alternate X-shaped embodiment of the broom head which is the present invention, adapted for usage with a motorized vehicle.
Figure 6:
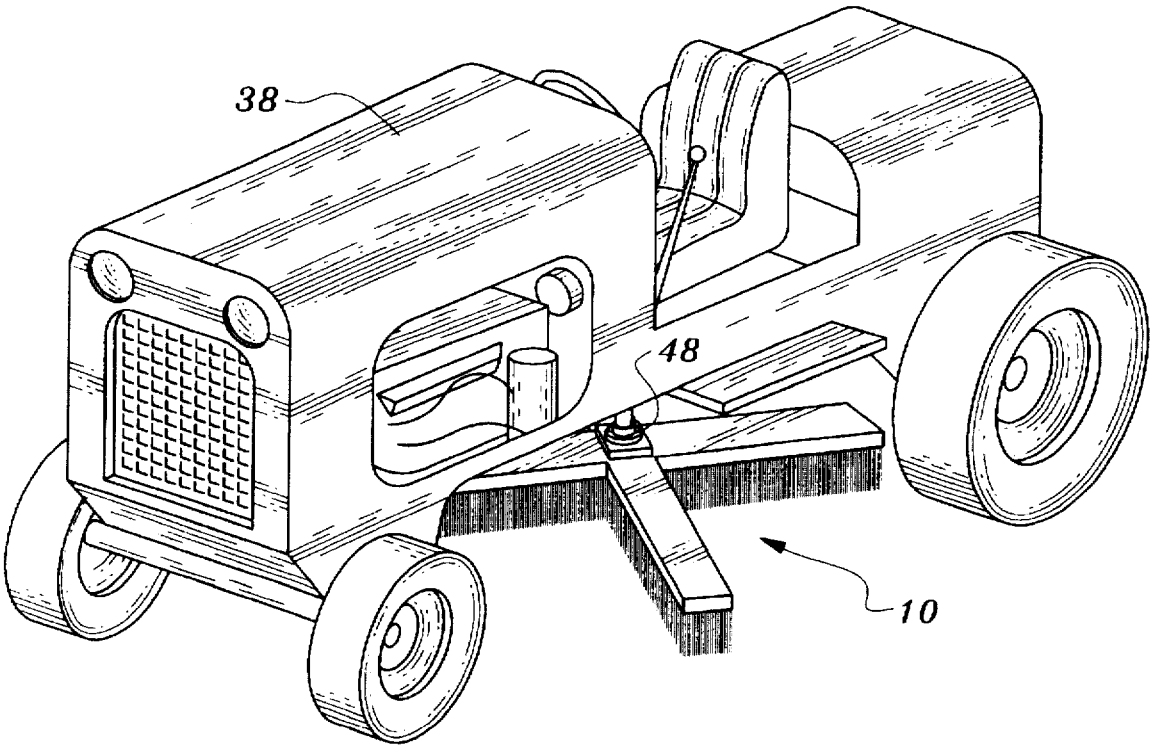
FIG. 6 is a side perspective view of the alternative X-shaped embodiment coupled to a tractor.

FIGS. 5 and 6 shows an alternate embodiment of broom head 10 which is adapted for use with a motorized vehicle 38. This embodiment adopts an "X"-shape due to the convergence of four elongate arms 40, 42, 44, 46, which allows for two interior angles 18, ranging from 90 to 145 degrees, to be arranged back to back, thereby allowing two leading edges 25 to be brought to bear upon any spreadable material for purposes of channeling it. Leading edges 25 continue in an unbroken manner along arms 40, 42, 44, 46 for purposes of capturing and channeling spreadable material. This embodiment can be adapted to a motorized vehicle 38 for allowing cracks to be filled, whether the vehicle is traveling in forward or reverse. In this embodiment the support structure 30 described for the manual embodiment is excluded. Instead, a coupling attachment upon the motorized vehicle would couple to an adaptor 48 on the broom head 10 which couples at the convergence of arms 40, 42, 44, and 46. The broom head 10 could then be raised and lowered and used in forward or reverse for highly efficient crack filling. As in the embodiment shown in FIG. 3*b*, the bristles 22 on the X-shaped embodiment can be tapered as they as they proceed from the leading edge 25 to the trailing edge 26.

Accordingly, it will be seen that this invention provides a broom head which channels dispersed material into a narrow channel. The channeling characteristic of this broom head allows for efficient crack filling to occur during a paving operation. This broom head can be adapted for manual crack filling or for crack filling using a motorized vehicle.

Although the description above contains many specificities, these should not be construed as limiting the scope of the invention, but as merely providing illustrations of some of the presently preferred embodiments of this invention. Thus the scope of this invention should be determined by the appended claims and their legal equivalents.

I claim:

1. A broom apparatus for channeling spreadable material, the apparatus comprising:

a) a first broom arm and a second broom arm, said broom arms having both a topside and an underside;

b) said first and second arms joined centrally, at a junction point to form a V-shape, said junction of said arms forming an interior angle between said arms, said angle in a range of between 90 and 145 degrees;

c) a plurality of bristles depending down from said underside of said broom arms, said bristles forming a V-shaped leading edge along said interior angle of said arms, said bristles continuing aback from said leading edge and forming a tapered section of bristles which terminate at a trailing edge;

d) said leading edge contacting and channeling said spreadable material toward said junction point;

e) a broom handle for pushing said broom apparatus upon a ground surface;

f) a collar, said collar for surrounding said broom handle; and g) first and second elongate struts having first and second opposing ends, said struts each coupled to said collar at said first ends, said struts each coupled to said broom arms at said second ends.

* * * * *